US006562158B1

(12) United States Patent
Kretchmer

(10) Patent No.: US 6,562,158 B1
(45) **Date of Patent: *May 13, 2003**

(54) HEAT-TREATABLE PLATINUM-GALLIUM-PALLADIUM ALLOY FOR JEWELRY

(76) Inventor: Steven Kretchmer, Route 23 A, Palenville, NY (US) 12463

( * ) Notice: Subject to any disclaimer, the term of this patent is extended or adjusted under 35 U.S.C. 154(b) by 0 days.

This patent is subject to a terminal disclaimer.

(21) Appl. No.: 09/857,380

(22) PCT Filed: Dec. 1, 1998

(86) PCT No.: PCT/US98/25457

§ 371 (c)(1),
(2), (4) Date: Sep. 10, 2001

(87) PCT Pub. No.: WO00/32829

PCT Pub. Date: Jun. 8, 2000

(51) Int. Cl.[7] ..... C22F 1/14
(52) U.S. Cl. ..... 148/678; 148/538; 148/430; 148/405
(58) Field of Search ..... 148/678, 538, 148/430, 405; 420/466

(56) References Cited

U.S. PATENT DOCUMENTS

| | | | | |
|---|---|---|---|---|
| 4,165,983 | A | 8/1979 | Bourne et al. | 420/466 |
| 4,324,777 | A | 4/1982 | Anderson | 423/579 |
| 4,822,699 | A | 4/1989 | Wan | 429/40 |
| 5,084,108 | A | 1/1992 | Kretchmer | 148/678 |

FOREIGN PATENT DOCUMENTS

| | | |
|---|---|---|
| JP | 57-169041 | * 10/1982 |
| JP | 57210936 | 12/1982 |
| JP | 61270349 | 11/1986 |
| JP | 61270350 | 11/1986 |
| JP | 61270351 | 11/1986 |
| JP | 61272333 | 12/1986 |
| JP | 61272334 | 12/1986 |
| JP | 61272335 | 12/1986 |
| JP | 61272336 | 12/1986 |
| JP | 61272337 | 12/1986 |
| JP | 62-56544 | 3/1987 |

OTHER PUBLICATIONS

Japanese Application Patent Abstract No. JP 2250946, filed Oct. 8, 1990.
Japanese Application Patent Abstract No. JP 61272337 A filed Dec. 2, 1986.
Japanese Application Patent Abstract No. JP 61272336, filed Dec. 2, 1986.
Japanese Application Patent Abstract No. JP 61270351 A, filed Nov. 29, 1986.
Japanese Application Patent Abstract No. JP 61270350 A, filed Nov. 29, 1986
Japanese Application Patent Abstract No. JP 61270349 A, filed Nov. 29, 1986.
Japanese Application Patent Abstract No. JP 57210936 A, filed Dec. 24, 1982.

* cited by examiner

*Primary Examiner*—John Sheehan
(74) *Attorney, Agent, or Firm*—Winston & Strawn

(57) ABSTRACT

A method of making jewelry comprising formulating a platinum alloy of at least 95 weight percent platinum, 1 to 5 weight gallium and palladium in an amount of less than about 3 weight percent, heat treating this alloy to increase the Vickers hardness by at least 20% but to not greater than a Vickers hardness of 350.

7 Claims, No Drawings

HEAT-TREATABLE PLATINUM-GALLIUM-PALLADIUM ALLOY FOR JEWELRY

TECHNICAL FIELD

The present invention relates to platinum-gallium-palladium alloys which are heat-treatable to high strength and hardness for use in jewelry, art objects and related articles.

BACKGROUND ART

It is known in the jewelry-making art that the hardness and strength of alloys can be increased by cold deformation. That is, it is known how to work gold and platinum alloys by various forging processes to harden and increase yield strength to create stronger components, and for the use of exerting spring pressure. Increased strength is necessary for many types of durable structural parts such as lighter chains, pin stems, and thinner stampings. Spring pressure can be applied to form spring components for clasps, closures, wires, and springs. Even rings, pendants, bracelets, can mount center gemstones by compression spring power. The necessary pressure, in the latter examples, is supplied by the springiness inherent in the structure of the worked precious metal mounting itself.

It is also known to those interested in the metallurgy of precious metals that many gold alloys and certain platinum alloys can be hardened by heat-treatments to increase their hardness and yield strengths, sometimes even more than is possible through cold working. In this regard, U.S. Pat. No. 5,084,108 discloses a heat-treatment process for increasing the strength of certain alloys specifically for use as compression-spring gemstone mountings.

Platinum is a precious metal and is relatively expensive. Platinum for fine jewelry is sold in high concentrations of over 90% and, by law, must be hallmarked accordingly. Platinum alloys are desirable for their neutral color when combined with gems, they are hypo-allergenic, they have high tensile strength, and a pleasurable heft due to its high-density. In America, platinum alloys for jewelry manufacturing traditionally have concentrations of over 90 percent platinum and contain small amounts of iridium or ruthenium. There has been a recent introduction of platinum-cobalt alloys for casting alloys that are somewhat harder than the traditional iridium or ruthenium platinum alloys. Although work-hardenable, they are permanently softened by heat when soldering or using other metalworking techniques in jewelry manufacturing. Platinum-cobalt alloys do not respond to heat-treatments.

U.S. Pat. No. 5,084,108 discloses certain heat treatable alloys of platinum containing 5 to 25% copper, 5 to 50% gold, 10 to 40% indium, 10 to 70% iron or 7 to 35% silver. None of these alloys contain gallium or palladium, nor is there any specific disclosure of hardness for these platinum alloys. Instead, that patent is primarily concerned with the strengthening of certain alloys to provide compression spring mountings for gemstones.

Various gallium containing platinum alloys are known in the field of metallurgy. These alloys include 89–98.9% Pt, 1.1–11% Ga; 85–95% Pt, 2–4% Ga, 3–12% Cu; 95% Pt, 2–2.5% Ga, 2.5–3% Au; and 95% Pt, 2–3% Ga, 1–3% Au, 0–2.5 In. To the present inventor's knowledge, however, none of these alloys have been heat-treated to increase strength and hardness for use as jewelry components.

U.S. Pat. No. 4,165,983 discloses a number of different alloying elements including palladium that can be used with platinum-gallium alloys, but is silent as to whether any heat treatments should be conducted on these alloys, despite a recognition that for many platinum jewelry applications, much harder metals (i.e., harder than 200 Vickers) are needed for use in the manufacture of springs and clasps. The solution to the problem of low hardness taught in this patent relates to a modification of the type and amount of alloying elements. Again, heat treatments are not used to increase hardness.

There are known heat-treatable platinum alloys such as 90% platinum-10% gold, but these alloys have undesirable characteristics for jewelry work. A 90% Pt, 10% Au alloy tends to crack, is extremely difficult to draw into wire or roll, and does not cast well by known jewelry-making techniques. Platinum (90%+)/copper, used in Europe, does not significantly respond to heat-treatments, and only can be strengthened by a few percent.

Due to the potential improvements in properties and performance of such heat-treated alloys, there is a need for additional alloys that are heat-treatable for use in jewelry and art applications. The present invention provides one alloy family for this purpose.

SUMMARY OF THE INVENTION

The present invention relates to a method for making jewelry, which comprises formulating a platinum alloy of at least about 95 weight percent platinum, about 1 to 5 weight percent gallium and an additional alloying element of palladium in an amount effective as a property enhancing agent but in a total amount of less than about 3 weight percent. This alloy is heat-treated to increase its initial Vickers hardness by at least about 20% but to not greater than a Vickers hardness of 350. Preferably, the alloy has an initial hardness of about 150 to 200 and this is increased to about 250 to 325 after heat treatment. More preferably, the initial hardness is at least about 160 and is increased to at least about 275. The heat-treated alloy has particular properties that render it useful as in general purpose jewelry applications.

In this method, the two stage heat-treating operation may include solution-treating the alloy at a temperature of at least about 1700 F., quenching the solution-treated alloy to a temperature of below about 200 F., and then, hardening the quenched alloy at at least 900 F. for a sufficient time to achieve the desired hardness. Preferably, the solution-treating temperature is at least 1800 F., the alloy is held at that temperature for at least 10 minutes, and the solution-treating step is conducted in an inert, non-oxidizing or anti-oxidizing environment. The solution-treated alloy is then quenched in water that is at room temperature or colder. Also, the hardening treatment is preferably conducted by heating the alloy in an inert, non-oxidizing or anti-oxidizing gas atmosphere for at least 30 minutes at 1100 to 1200 F. The hardened alloy is then cooled to room temperature.

The alloy may be formed into a desired shape prior to the two-stage heat-treating operation. Such operations are many and include casting or fabricating. Some examples of fabrication can be by rolling of the alloy into a sheet, drawing a wire, molding, casting, forging, stamping or constructing the object or shape useful as a jewelry component. It is also useful to process the hardened alloy to remove or prevent surface oxidation. One method to remove surface oxidation is by abrasion, although as previously mentioned, the alloy may be shielded during the heat-treating operations to prevent surface oxidation.

DESCRIPTION OF THE PREFERRED EMBODIMENTS

The invention of this particular high-concentration platinum alloy hardened significantly by heat-treatment is extremely appropriate for the manufacturing of jewelry, allowing for many advantages to the jewelry manufacturer over presently utilized alloys, such as:

1) Thinner, lighter constructions and castings, possessing significantly lowered weight and costs.
2) Springier clasps and mechanisms, not previously possible to construct.
3) Strengthening of delicate fabrications such as prong setting after construction.
4) Higher polish, much easier to achieve, due to increased hardness.
5) Lower casting temperatures than previously known.
6) Lower costs with alloy additions other than traditional iridium or ruthenium.
7) Expanded jewelry design possibilities.

The invention is preferably directed to platinum-gallium-palladium alloys that can be cast to a desired form or worked by traditional fabrication methods in an annealed state, then heat-treated and age-hardened to significantly increase their yield strengths so that they become hardened and spring-like. The alloys can be used for a wide variety of jewelry components, such as rings, clasps, spring parts, even compression-spring settings for gemstones, and the like. These alloys can be repeatedly annealed and heat-treated/age-hardened, and will actually increase in strength at room temperature over time.

As used herein, the term "age-hardening" is essentially synonymous with the term "precipitation hardening" which results from the formation of tiny particles of a new constituent (phase) within a solid solution. The presence of these particles create stress within the alloy and increase its yield strength and hardness. See, B. A. Rogers, "The Nature of Metals", p.320 (Iowa State University Press, 1964); H. W. Polock, "Materials Science and Metallurgy, p. 266 (Reston Pub. Inc. 1981) and "The Metals Handbook", pp.1–2 (Am. Soc'y Metals, 1986).

A multitude of shapes or forms for the platinum-gallium-palladium alloys of the invention can be hardened by heat-treatments before being utilized as jewelry. Mountings can hold stones by significant compression-spring power.

In their annealed/softened state the alloys can be worked by standard jewelry-making techniques: they can be rolled, drawn, soldered to, shaped, bent, stamped, etc. These alloys can be applied to a variety of designs for springs, gemstone mountings in rings, pendants, bracelets, chains, precious metal art objects, and the like.

It should be noted that in designing for structure of the jewelry or art object, the smallest cross-sectional area and shape of a component is taken into account. It is possible to adapt the design of the alloy to almost any configuration. The basic forms of these designs can vary, from simple sheet, to ring-shapes and more complex helixes, v-shapes, and the like. Objects can be wire, sheet, springs of all types, pendants, chain-links, brooches, and a multitude of others. Standard jewelry soldering techniques can be applied and repairs requiring heat can be carried out. The alloys can be shaped, bent, built onto, annealed, and when the piece is done, the spring power and hardness can be regained by heat-treatment. The alloy can be used to add durability to any jewelry component. Due to its superior hardness, its finish will also last longer.

The hardness and strength of the alloys are increased by a simple heat-treatment. The piece need not be forged to shape, like a coin is struck, or a ring pounded on a mandrel with a hammer, etc. Rather, the piece can be cast to any desired shape, or worked to its finished form before spring power or hardness is increased in it.

Not only does the technique of the present invention allow for more possibilities than prior art work-hardening techniques for obtaining hardness or spring power, but the equipment involved is more economical. Instead of presses, dies, and drop-hammers to create spring power for a production of pieces, a simple electric furnace, hot oil bath, or the like, is all that is required.

There are three basic steps when using construction methods to make components of heat-treatable precious metal hardenable alloys according to the present invention. First, after the ingot is poured, the alloy should be cold-work reduced in cross sectional dimension before construction is begun, that is, it must be rolled or drawn down (broken down). Second, after the piece is constructed by standard jewelry fabrication techniques and is in its final form, the piece must be completely solution-treated. Third, it must be hardened by heat-treatment in an oven for a certain amount of time (controlled precipitation). It can then be cooled to ambient temperature.

In the case of as-cast shapes made of heat-treatable alloys, there are two basic steps to increase their spring power according to the present invention. After it is in its final form, the piece must first be completely solution-treated. Second, it must be hardened by heat-treatment in an oven for a certain amount of time (controlled precipitation). It can then be cooled to ambient temperature.

The invention is created by the addition of 1 to 5 weight percent of the element gallium to platinum. Even additions of less then 3 percent gallium allow significant, beneficial hardening effects by heat-treatment. The addition of gallium in small quantities to platinum costs significantly less than iridium or ruthenium and creates an unexpectedly unique and advanced product for jewelry manufacturing.

As too much gallium can cause excessive hardness, the present invention recognizes that palladium can be added as a diluent to ameliorate the hardness increases that occur during heat treatment without affecting the desirable properties of platinum-gallium alloys. Furthermore, the palladium addition imparts beneficial properties to the resulting alloy.

The examples demonstrate that the heat treatment of an alloy of platinum, 1–5% gallium, and 3% or less of palladium provides a material that is extremely useful for jewelry applications because of its combination of desirable properties, including malleability, melting range, fluidity, hardness, resistance to oxidation, heat treating ability and cost. Also, tests were conducted to demonstrate that platinum alloys containing 1, 1.5 or 2.25% palladium and 4, 3.5 or 2.75% gallium, respectively, also possess the necessary balance of properties to be useful as a general purpose jewelry alloy. The most preferred alloy contains 95% platinum, 2.5% gallium and 2.5% palladium. It was found that this preferred alloy has the best overall blend of properties for use in a variety of jewelry applications.

It is possible to add small or trace amounts of additional elements to the platinum-gallium-palladium alloys of the invention. When adding copper, cobalt, gold, iridium, silver, and/or indium, care has to be taken when selecting the maximum amount of the element or elements to include. Too much of those elements can result in increased oxidation when heated, reduced fluidity or adverse heat treating capabilities (i.e., too much or an insufficient response).

Testing has shown that such alloying elements, when used alone or in combination, have other beneficial effects on platinum-gallium-palladium alloys, such as grain refining or adjusting the resulting alloy. The additional of less than one percent of iridium, for example, can act as a grain-refiner, reducing grain-growth. Small amounts (i.e., less than 1%) of gold or cobalt are useful for increasing the fluidity of the resulting alloy, while similar amounts of gold or silver help fine tune the heat treatability and iridium is beneficial as a grain reducer. Copper, cobalt, gold, iridium, silver and/or indium can be added to increase the work hardenability of the final alloy. Additions of trace quantities of these elements vary the metallurgical structure and therefore the characteristics of the alloy. Each of these elements can be added in trace amounts provided that the total is less than about 2% by weight of the alloy.

The platinum-gallium-palladium alloy is preferably melted and blended together by induction heating in appropriate crucibles for platinum alloys, and poured through water to create grain-shot than can be dried, weighed and used for casting.

Any forms made in wax can be easily cast by well-known traditional lost-wax casting techniques for platinum. Significantly, these platinum-gallium-palladium alloys cast easier than any other previously known platinum alloy and are more energy efficient, due to their relatively low melting temperature. This lower temperature alloy also allows a lower mold temperature, decreasing defect rate due to shrinkage porosity, investment cracking, inclusions, and contaminations that occur more readily at highly-elevated temperatures.

Ingots for sheet or wire fabrication can easily be cast by either investment lost-wax casting methods or into ingot molds for platinum. The alloy can be rolled to approximately a 30 to 40 percent reduction before needing an annealing procedure.

These platinum-gallium-palladium alloys are annealed at a temperature around 1800 F. by either furnace or torch to an orange-yellow, followed by an immediate quench in water.

There is slight surface oxidation that appears as a darkening or haze that forms on the surface of this alloy during high-temperature operations and can be prevented by dipping the alloy in boric-acid/alcohol solution before bringing it to high temperature. Many known method for prevention of surface oxidation work well such as utilizing a shielding-gas or stainless-steel foil-wrap in combination with the boric-acid dip. Otherwise, the oxidation can simply be removed by abrasion with emery paper or polishes.

The hardening of this alloy is a two-step procedure. Solution-treating is necessary previous to the hardening heat-treatment, to maximize hardening and its uniformity.

The alloy in cast form, in the form of sheet or wire stock, or in the form as a finished piece can be solution-treated at temperature near 1800 F. in a furnace, preferably atmosphere-controlled with shielding-gas. Times vary for differing thicknesses. For an example, thirty minutes is an adequate amount of time for wire of over two millimeters in diameter. The alloy must be immediately quenched in water from the furnace.

The second heat-treatment, the hardening step of the platinum-gallium-palladium alloy involves heating the piece at approximately 1200 F. for a period of one hour in a furnace, preferably atmosphere-controlled with shielding-gas. It can be allowed to air cool outside the furnace.

The shielding gas can be any of the non-oxidizing inert gasses, such as argon, nitrogen, or mixtures thereof; anti-oxidizing gasses such as hydrogen, carbon monoxide, or "forming" or "cracked ammonia" gas (nitrogen with a few percent of hydrogen). The piece can also be protected from oxidation by enveloping them with commercially available heat-treating wraps.

EXAMPLES

The following examples illustrate the most preferred embodiments of the platinum-gallium alloys of the invention.

Example 1

A 95% gallium, 5% gallium alloy was made and then cast into a wire. A solution treatment of 1800 F. for 30 minutes under argon gas in conducted, followed by a quench into room temperature water. Next, a hardening step is conducted where the quenched alloy is heated to 1200 F. for about 1 hour under argon gas. The alloy is then allowed to cool to room temperature. Vickers hardness measurements are taken on this material after the solution treatment, and after the hardening step. These values are reported in Table 1. The hardening step raises the Vickers hardness about 70%.

Example 2

The same alloy as in Example 1 is rolled to a flat strip before being subjected to the same solution treatment and hardening steps. The Vickers hardness measurements for this alloy is also shown in Table 2. A hardness increase of about 75% is seen.

An increase in hardness implies an increase in strength and elasticity, as well as a reduction in ductility. Increases in hardness of at least about 25% to 50% are useful for many applications, although even higher increases can be obtained as shown in these examples.

TABLE 1

| | Vickers Hardness (500 gm load) | |
|---|---|---|
| Alloy (Form) | Range | Average Hardness (HV) |
| Cast-Solution Annealed | 200–222 | 210 |
| Cast-Hardened | 340–385 | 361 |
| Rolled-Solution Annealed | 204–385 | 213 |
| Rolled-Hardened | 350–384 | 374 |

Example 3

A platinum alloy for general purpose jewelry applications must have a balance of properties to be useful and accepted by the industry. These properties include wear resistance, hardness, malleability, fluidity, melting point, oxidation resistance and cost. Table 2 presents a comparison of the properties of 99.9% platinum against alloys of 95% platinum-5% gallium ("95-5 alloy"), and 95% platinum-2.5% gallium-2.5% palladium ("95-2.5-2.5 alloy").

TABLE 2

| | PERFORMANCE TESTS | | | | | | |
|---|---|---|---|---|---|---|---|
| Material | Wear Resistance | Hardness | Malleability | Fluidity | Melting Point | Amount of Oxidation | Cost |
| 99.9 Pt | Low | Softest | Very High | Low | Highest | Least | High |
| 95 Pt 5 Ga | Very high | Hardest | Low | Higher | Low | Most | Lower |

TABLE 2-continued

| PERFORMANCE TESTS | | | | | | | |
|---|---|---|---|---|---|---|---|
| Material | Wear Resistance | Hardness | Malleability | Fluidity | Melting Point | Amount of Oxidation | Cost |
| 95 Pt 2.5 Ga 2.5 Pd | High | Moderate | High | Highest | High | Low | Lowest |

Adding gallium to high purity platinum results in an alloy that is hard and can be heat-treated for even greater hardness. 99.9% platinum has an annealed Vickers hardness of 37 to 50, while that of the 95-5 alloy is 200–222 and the 95-2.5-2.5 alloy is about 125–150. When the 95-5 alloy is heat-treated in accordance with the conditions of Example 1, its hardness is increased to a Vickers hardness of about 340 to 385. The same heat-treatment of the 95-2.5-2.5 alloy results in a Vickers hardness of about 220 to 225. If gallium is used in an amount of more that 5% and heat-treated according to Example 1, the resulting heat-treated platinum-higher gallium alloys have a Vickers hardness of over 400 and are far too hard for use as general purpose jewelry alloys. This is so even when those platinum-higher gallium alloys are annealed and quenched to their softest state. The hardness of the platinum-higher gallium alloy causes jewelry files to become dulled when the work is shaped before heat treatment.

In contrast, the 95-2.5-2.5 alloy has a relatively softer hardness which enables the alloy to be shaped before heat treatment. Although it is harder that 99.9% platinum, the 95-2.5-2.5 alloy is readily workable. Wear resistance is related to hardness, with harder materials providing greater wear resistance.

The results show that the 95-2.5-2.5 alloy has the best overall blend of properties for use in various jewelry applications ranging from resilient spring clasps to malleable sheet stock which can be stamped or formed into shapes without tearing. The amount of oxidation present after a brazing or heat treatment operation is minimal and can be easily removed by conventional polishing to produce a lustrous surface. The fluidity enables the material to be easily cast into desired shapes, while its high melting range enables repairs to be made with conventional platinum brazing materials without great concern of damaging the piece.

The fluidity of a jewelry alloy is related to its melting range and is important for casting quality. 99.9% platinum melts at about 1773° F., whereas the 95-5 alloy has a melting range of about 1420 to 1610° F. and 95-2.5-2.5 alloy has a melting range of about 1620 to 1685° F. The 95-5 alloy begins to melt at too low of a temperature so that it is difficult to work on the alloy using standard brazing alloys without damaging the jewelry article. This is a concern when repairs need to be made to the article. The 95-2.5-2.5 alloy begins to melt at a higher temperature, so is less sensitive to this type of damage. Also, the melting range of the 95-2.5-2.5 alloy compared to the 95-5 alloy enables the alloy to flow well, particularly when used to cast and fill very fine forms or molds.

Regarding malleability, i.e., the ability of a metal or alloy to be hammered or rolled, 99.9% platinum can undergo a percent reduction of 95 or more before needing to be annealed. The annealing operation is necessary to avoid defects such as cracks in the final article. Although 99.9% platinum is very malleable, it is too soft to provide appropriate wear resistance. The 95-5 alloy being much harder, only can be reduced by about 30% before requiring an anneal, whereas the 95-2.5-2.5 alloy can be reduced by about 70% before an anneal is required. The 95-2.5-2.5 alloy provides an unexpected increase by a factor of more than 2 in malleability compared to the 95-5 alloy.

Although reducing the quantity of gallium in the platinum 5% gallium alloy can lower the hardness values, the cost of the alloy would be increased as the proportion of platinum is increased. Also, the annealed Vickers hardness would decrease due to the use of lower amounts of gallium but only to about 190–200 (for use of 3.5% to 4% gallium). Furthermore, the malleability percent reduction would increase only to about 44 to 55% for these alloys. The melting range would be about 1580 to 1660° F. Also, these alloys oxidize to a greater extent than platinum-gallium-palladium alloys, so that platinum-gallium alloys are not desirable for use as general purpose jewelry alloys.

The addition of palladium in amount preferably ranging about 1 to 2.5 weight percent palladium to 95% platinum-2.5 to 4% gallium achieves a balance of properties so that the alloys are highly useful in general purpose jewelry applications. In addition, these palladium containing alloys are of lower cost. Specifically, it has been found that the substitution of palladium to replace some of the platinum or gallium in a platinum-gallium alloy enables the resultant alloy to have more desirable hardnesses, fluidity, oxidation resistance and melting range without increasing the platinum content and cost of the alloy.

Example 4

Additional tests were conducted to illustrate the usefulness of additional platinum-gallium-palladium alloys of this invention. Three alloys were made: each contained 95% platinum with Alloy A containing 2.75% gallium and 2.25% palladium Alloy B containing 3.5% gallium and 1.5% palladium and Alloy C containing 4% gallium and 1% palladium. Results are shown below in Table 3.

TABLE 3

| PERFORMANCE TESTS | | | | | |
|---|---|---|---|---|---|
| Material | Annealed Vickers Hardness | Heat-treated Hardness* | Malleability % reduction before anneal | Fluidity ** | Melting Range |
| Alloy A | 125 | 160 | 65 | high | 1615 to 1670 |
| Alloy B | 188 | 268 | 55 | high | 1560 to 1650 |
| Alloy C | 192 | 307 | 45 | high | 1565 to 1640 |

*per Example 1
**very castable; fills fine forms easily and well.

The amount of oxidation of these alloys is comparable to 95-2.5-2.5 alloy and better than platinum-gallium alloys having equivalent gallium contents and is much easier to remove. Also, these alloys have a relative cost which is less than 99.9% platinum and platinum/gallium (alone) alloys having equivalent gallium contents and is comparable to 95-2.5-2.5 and 95-5 alloys.

The foregoing examples are intended to illustrate typical improvements in strength and hardness that can be obtained using the present platinum-gallium alloys and the novel heat-treatment process disclosed herein. Of course, higher or lower values can be attained by conducting routine tests. Thus, it is understood that changes and variations can be made in the foregoing without departing from the scope of the invention which is defined in the following claims.

What is claimed is:

1. A method for making jewelry, which comprises:

formulating a platinum alloy of at least about 95 weight percent platinum, about 1 to 5 weight percent gallium, and an additional alloying element of palladium in an amount effective as a property enhancing agent but less than about 3 weight percent, said alloy having an initial Vickers hardness;

heat-treating the alloy to increase the Vickers hardness by at least about 20% but to not greater than a Vickers hardness of 350; and utilizing the heat-treated alloy as a component of jewelry.

2. The method of claim 1 wherein the heat-treating operation comprises solution-treating the alloy at a temperature of at least about 1700 F.; quenching the solution-treated alloy to a temperature of below about 200 F.; and hardening the quenched alloy at at least 900 F. for a sufficient time to achieve the desired hardness.

3. The method of claim 2 wherein the solution treating temperature is at least 1800 F., the alloy is held at that temperature for at least 10 minutes, the solution-treating step is an annealing step conducted in an inert, non- or anti-oxidizing environment, and the annealed alloy is quenched in water.

4. The method of claim 2 wherein the hardening heat-treatment is conducted by heating the alloy in an inert, non- or anti-oxidizing gas atmosphere for at least 30 minutes at about 1100 to 1200 F.

5. The method of claim 4 wherein the hardened alloy is cooled to room temperature.

6. The method of claim 1 wherein palladium content is between 0.5 and 2.5 weight percent, the initial Vickers hardness is between 125 and 200 and the final Vickers hardness is between 150 and 300.

7. The method of claim 1 further comprising adding one or more property enhancing elements to the alloy in a total amount of no more than 2 percent.

* * * * *